US007437903B2

(12) United States Patent
Cheng

(10) Patent No.: US 7,437,903 B2
(45) Date of Patent: Oct. 21, 2008

(54) LOCK ASSEMBLY

(75) Inventor: Chin-Yuan Cheng, Taichung (TW)

(73) Assignee: Shengde Industries Co., Ltd., Taichung (TW)

( * ) Notice: Subject to any disclaimer, the term of this patent is extended or adjusted under 35 U.S.C. 154(b) by 0 days.

(21) Appl. No.: 11/654,612

(22) Filed: Jan. 18, 2007

(65) Prior Publication Data

US 2008/0173050 A1 Jul. 24, 2008

(51) Int. Cl.
*E05B 37/00* (2006.01)

(52) U.S. Cl. ..... 70/284; 70/312

(58) Field of Classification Search ..... 70/284, 70/285, 67–75, 312, 315–318, DIG. 63, DIG. 71
See application file for complete search history.

(56) References Cited

U.S. PATENT DOCUMENTS 4,123,923 A * 11/1978 Bako ..... 70/74
4,348,878 A * 9/1982 Chang ..... 70/5
4,462,232 A * 7/1984 Yang ..... 70/312
4,487,043 A * 12/1984 Milles ..... 70/312
4,499,745 A * 2/1985 Ricouard et al. ..... 70/285
4,519,229 A * 5/1985 Yang ..... 70/312
4,520,641 A * 6/1985 Bako ..... 70/312
4,532,784 A * 8/1985 Yeh ..... 70/312
4,554,809 A * 11/1985 Yang ..... 70/312
4,557,122 A * 12/1985 Hwang ..... 70/312
4,671,088 A * 6/1987 Jeang ..... 70/312
4,686,842 A * 8/1987 Chen ..... 70/312
4,711,108 A * 12/1987 Garro ..... 70/312
4,719,777 A * 1/1988 Hwang ..... 70/312
4,732,021 A * 3/1988 Su ..... 70/312
4,766,748 A * 8/1988 Yang ..... 70/312
5,092,149 A * 3/1992 Bartsch et al. ..... 70/312
5,927,113 A * 7/1999 Yu ..... 70/312
6,912,880 B2 * 7/2005 Ling et al. ..... 70/71
7,266,980 B1 * 9/2007 Ma ..... 70/69
7,290,417 B1 * 11/2007 Huang ..... 70/285
2004/0011098 A1 * 1/2004 Yang ..... 70/284
2006/0248930 A1 * 11/2006 Elles et al. ..... 70/71
2006/0254329 A1 * 11/2006 Yu ..... 70/284
2007/0214850 A1 * 9/2007 Ma ..... 70/284

* cited by examiner

*Primary Examiner*—Suzanne D Barrett
(74) *Attorney, Agent, or Firm*—Browdy and Neimark, P.L.L.C.

(57) ABSTRACT

A lock assembly, which includes a casing with two lock through holes at one side, a combination lock mounted in the casing, a locking plate axially sliably mounted in the casing to block/open the lock through holes of the casing and having a hook portion at one end, an operating member operable to move the locking plate to block/open the lock through holes of the casing, a cylinder lock mounted in the casing and having a bottom actuatin block rotatable with a key, and a link, which has a protrudin block suspending at one side of the combination lock and movable by the bottom actuating block of the cylinder lock between a first position where the link is engageed with the hooked portion of the locking plate for movement with the locking plate and a second position where the link is desengaged from the hooked portion of the locking plate.

11 Claims, 6 Drawing Sheets

LOCK ASSEMBLY

BACKGROUND OF THE INVENTION

1. Field of the Invention

The present invention relates to locks and more particularly, to a lock assembly, which comprises a combination lock and a cylinder lock.

2. Description of the Related Art

FIG. 1 illustrates a conventional combination lock 1 used in a suitcase. The combination lock 1 works with hooks in the suitcase to control locking of the suitcase. When wishing to open the suitcase, the user must rotate the rotating discs 2 of the combination lock to show the correct combination. This design of combination lock is functional and easy to use. However, if the user forgets the correct combination of the combination lock, the user cannot open the combination lock. Further, all different commercially available combination locks do not provide any structure or means for allowing the user to open the lock in a normal way without rotating the rotating discs to show the correct combination.

SUMMARY OF THE INVENTION

The present invention has been accomplished under the circumstances in view. It is the main object of the present invention to provide a lock assembly, which is openable without rotating the rotating discs to show the correct combination if the user forgets the correct combination.

To achieve this and other objects of the present invention, the combination lock comprises a casing, which has two lock through holes on one sidewall thereof, a combination lock mounted in the casing on the middle, a locking plate, which is mounted in the casing and movable axially forwards/backwards relative to the casing and has two butts disposed at one lateral side thereof corresponding to the lock through holes of the casing and a hook portion at one end, an operating member, which is mounted in one end of the casing and operable to move the locking plate between a first position and a second position, a cylinder lock, which is mounted in the other end of the casing and has a bottom actuating block rotatable with a key, and a link, which has a protruding block suspending at one side of the combination lock and movable by the bottom actuating block of the cylinder lock between a first position where the link is engaged with the hooked portion of the locking plate for movement with the locking plate and a second position where the link is disengaged from the hooked portion of the locking plate.

DETAILED DESCRIPTION OF THE INVENTION

Figure 1:
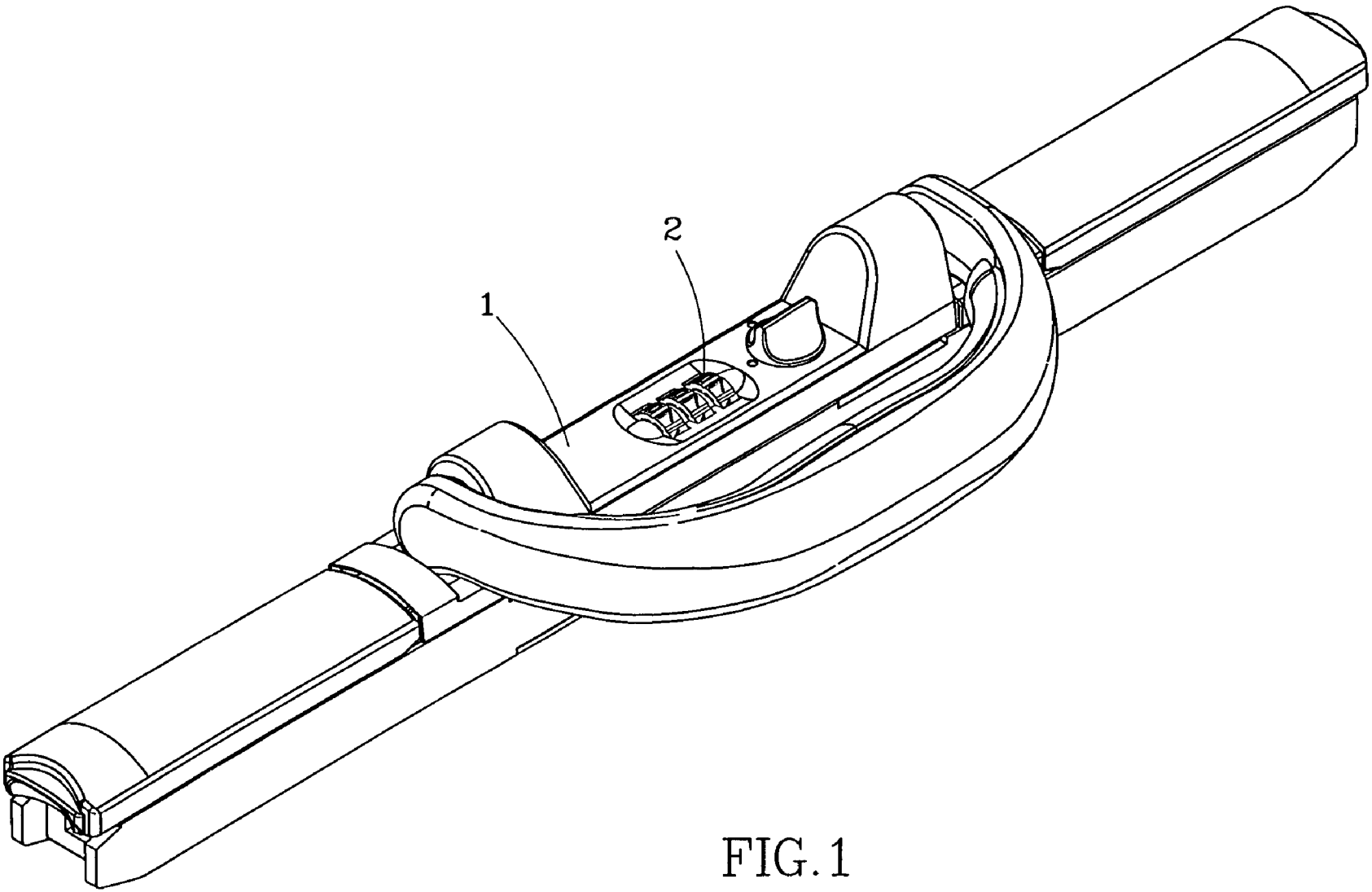
FIG. 1 is an applied view of a combination lock according to the prior art.

Referring to FIGS. 1~19, a lock assembly in accordance with a first embodiment of the present invention is shown comprised of a casing 10, a combination lock 20, a locking plate 30, an operating member 40, a cylinder lock 50 and a link 60.

The casing 10 is shaped like a channel bar (see FIG. 9), having two upright sidewalls 11 arranged at two sides. One upright sidewall 11 has at least one lock through hole, for example, two lock through holes 12 for receiving respective hooks in a suitcase.

The combination lock 20 is mounted in the casing 10 on the middle between the two upright sidewalls 11, comprised of a plurality of notched rotating disc and cam wheel sets 21, a shaft 22, and a movable plate 23. Because the combination lock 20 is of the known art, no further detailed description is necessary in this regard.

The locking plate 30 is mounted in the casing 10 and movable forwards/backwards in an axial direction relative to the casing 10, having two butts 31 at one lateral side, a hook portion 32 at the rear side, and a rack 33 at the front side.

The operating member 40 is mounted in one end of the casing 10 and operable to move the locking plate 30. According to this embodiment, the operating member 40 is a rotary knob having a gear 41 meshed with the rack 33 of the locking plate 30. Further, a driving member 42 is pivoted to the bottom side of the casing 10 and fixedly connected to the operating member 40 for rotation with the operating member 40. The driving member 42 has two driving rods 43 perpendicularly downwardly extending from the bottom side for moving a connecting plate in the suitcase to open two locksets of the suitcase.

The cylinder lock 50 is mounted in the other end of the casing 10 remote from the operating member 40, having a keyway 51 and a bottom actuating block 52. A proper key (not shown) can be inserted into the keyway 51 to rotate the bottom actuating block 52.

The link 60 has a horizontal bottom wall 61, a sliding slot 64 cut through the top and bottom sides of the horizontal bottom wall 61, a vertical sidewall 62 connected to one side of the horizontal bottom wall 61, and a protruding block 63 perpendicularly extended from the top side of the vertical sidewall 62 opposite to the horizontal bottom wall 61. The link 60 is mounted in the casing 10 to have the protruding block 63 suspending at one side of the movable plate 23 and to let the actuating block 52 be inserted into the sliding slot 64.

Figure 3:
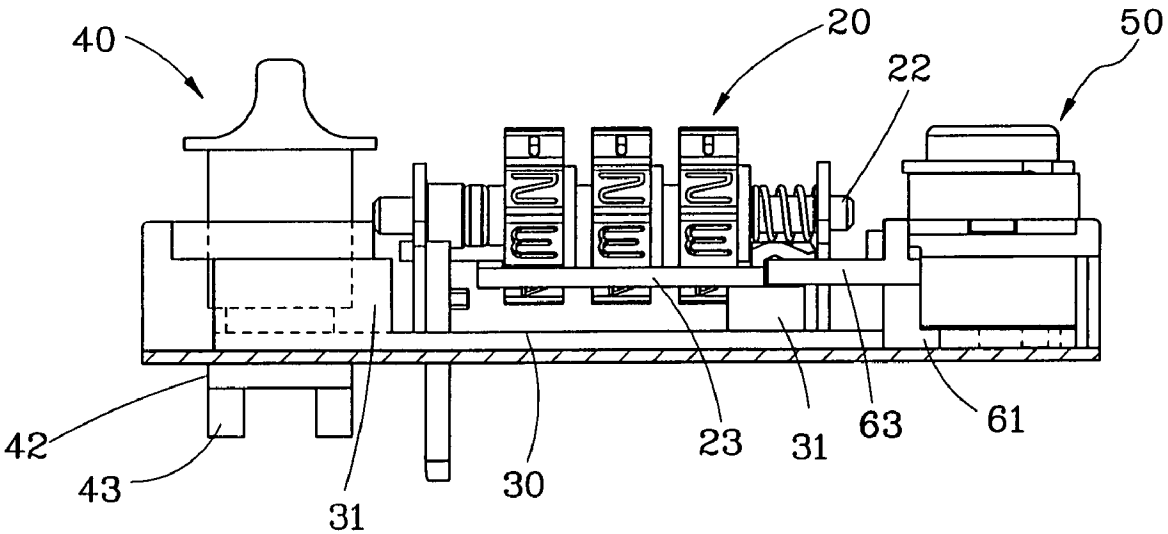
FIG. 3 is a sectional view taken along line 2-2 of FIG. 2.
Figure 4:
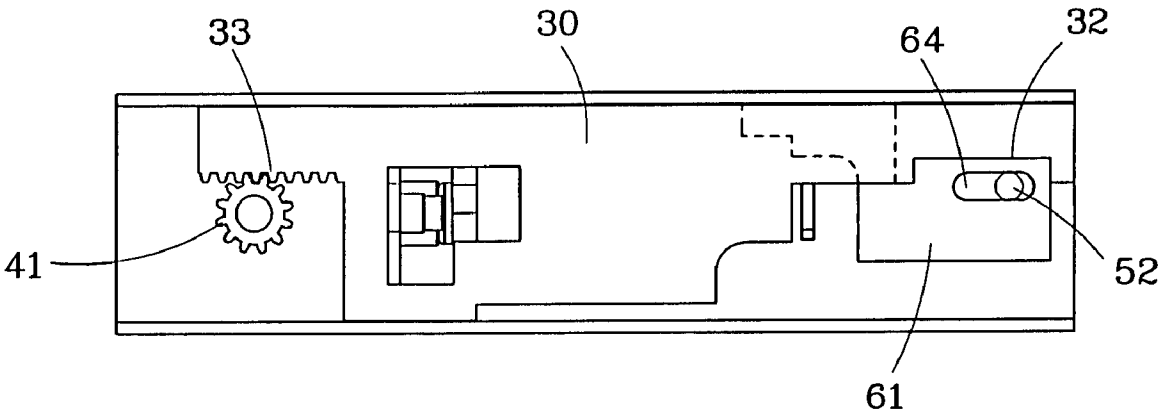
FIG. 4 is a sectional view taken along 3-3 of FIG. 2.
Figure 5:
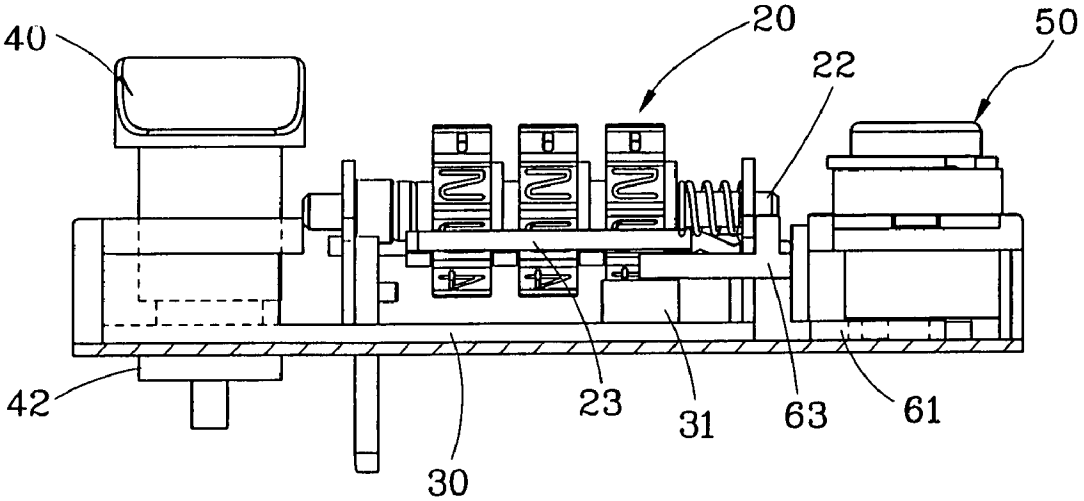
FIG. 5 is a sectional side view corresponding to FIG. 3.
Figure 6:
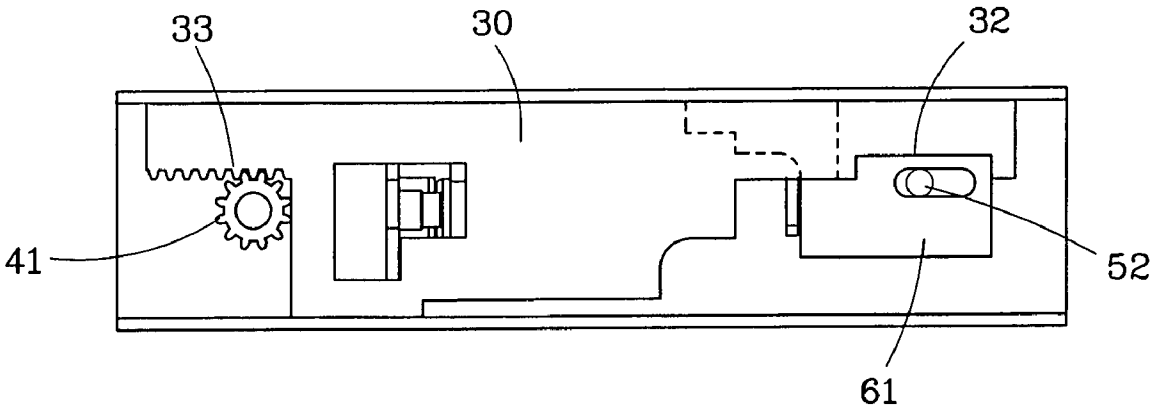
FIG. 6 is a sectional bottom view corresponding to FIG. 4.

When the cylinder lock 50 is locked, the actuating block 52 moves the link 60 into engagement with the hook portion 32 of the locking plate 30. When the user rotates the operating member 40, the locking plate 30 and the link 60 are simultaneously moved, and the two butts 31 respectively moved to the lock through holes 12 to prohibit disengagement of the respective hooks of the suitcase from the lock through holes 12. This action is same as the related conventional design. Before locking of the combination lock 20 (i.e., when the combination lock shows the correct combination), the locking plate 30 and the link 60 are movable by operating member 40, as shown in FIG. 5. However, when the combination lock 20 is locked, the movable plate 23 is forced down by the notched rotating disc and cam wheel sets 21, and the protruding block 63 is stopped against the movable plate 23, therefore the operating member 40 is not rotatable, as shown in FIG. 3.

Figure 7:
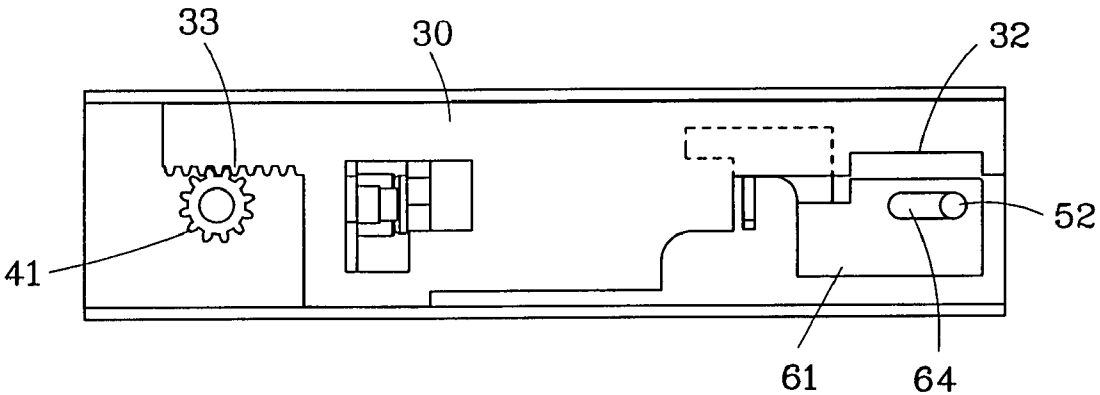
FIG. 7 is similar to FIG. 4 but showing the link disengaged from the hook portion of the locking plate
Figure 9:
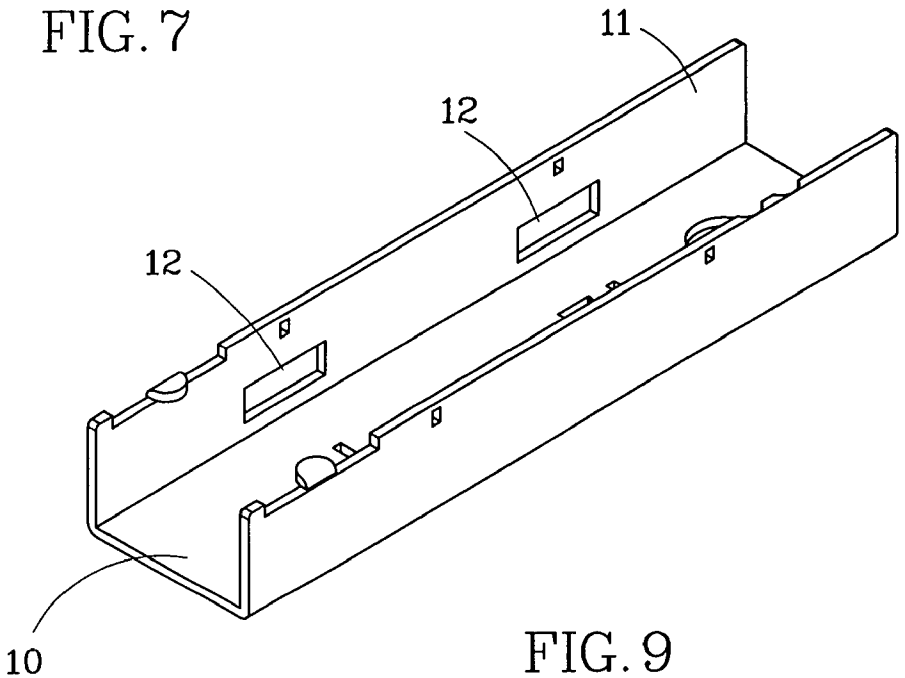
FIG. 9 is an elevational view of the casing according to the first embodiment of the present invention.
Figure 8:
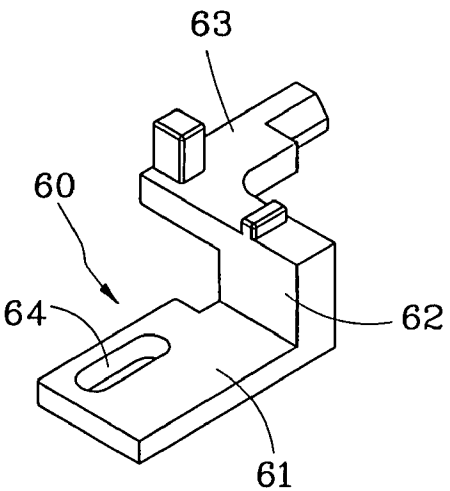
FIG. 8 is an elevational view of the link according to the first embodiment of the present invention.

When opening the lock assembly, the user can rotate the notched rotating disc and cam wheel sets 21 to show the correct combination, and therefore the lock assembly is unlocked. Alternatively, the user can open the cylinder lock 50 with the key. When turning the cylinder lock 50 with the key, the actuating block 52 is force to move the link 60 away from the hook portion 32 of the locking plate 30, as shown in FIG. 7. At this time, moving the locking plate 30 does not move the link 60, and the locking plate 30 is free from the constraint of the link 60. Therefore, the locking plate 30 is movable with the operating member 40 to carry the butts 31 away from the lock through holes 12 for allowing disengagement of the respective hooks of the suitcase from the lock through holes 12.

Therefore, after rotation of the cylinder lock 50 to move the link 60 away from the hooked portion 32 of the locking plate 30, the operating member 40 can be turned to move the locking plate 30 to unlock the lock assembly even if the combination lock 20 is in the locking position.

Figure 10:
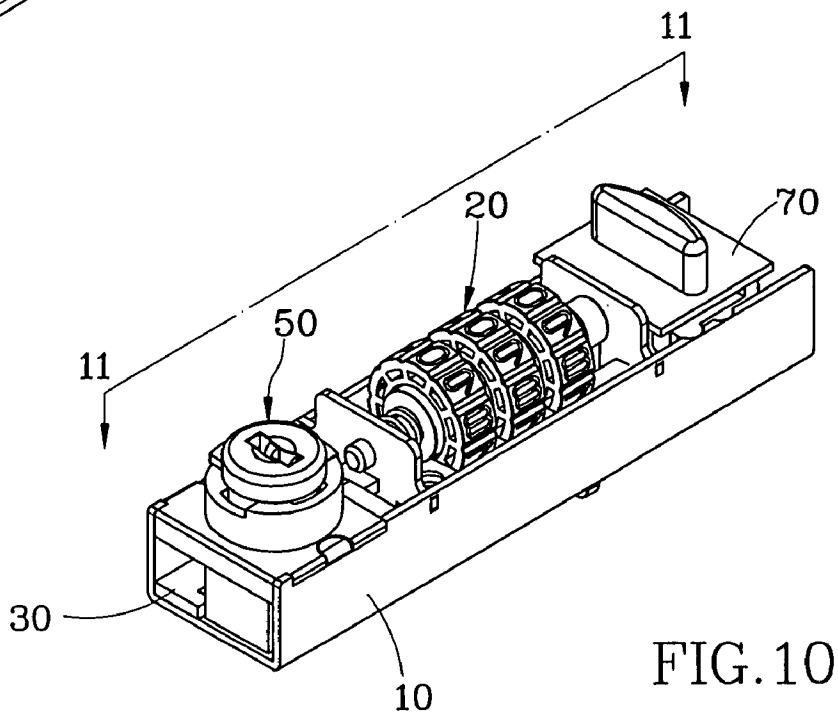
FIG. 10 is an elevational view of a lock assembly in accordance with a second embodiment of the present invention.
Figure 2:
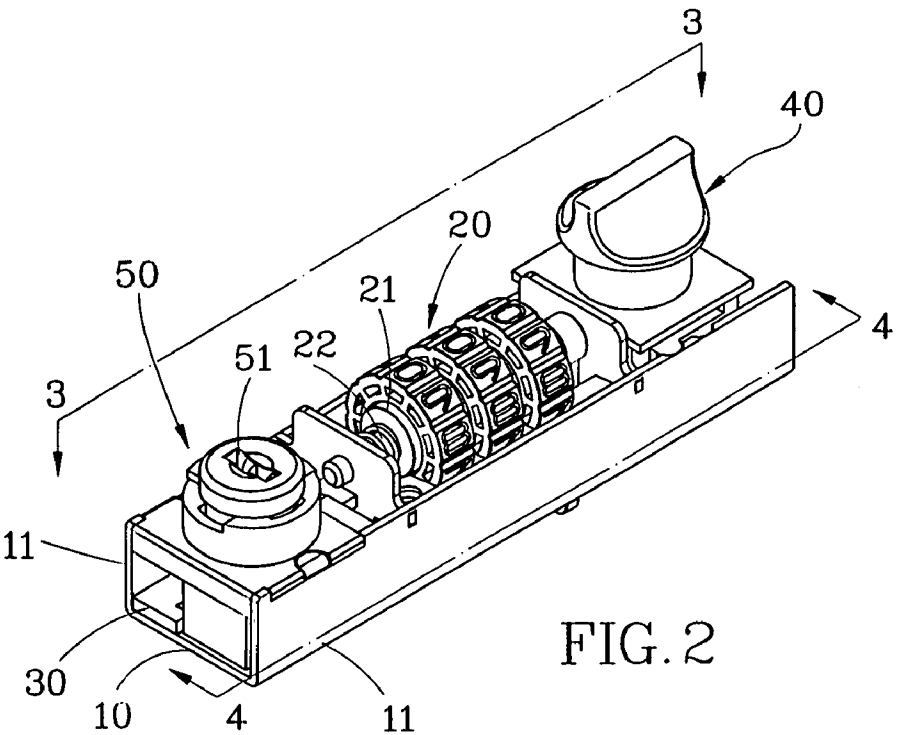
FIG. 2 is an elevational view of a lock assembly in accordance with a first embodiment of the present invention.
Figure 11:
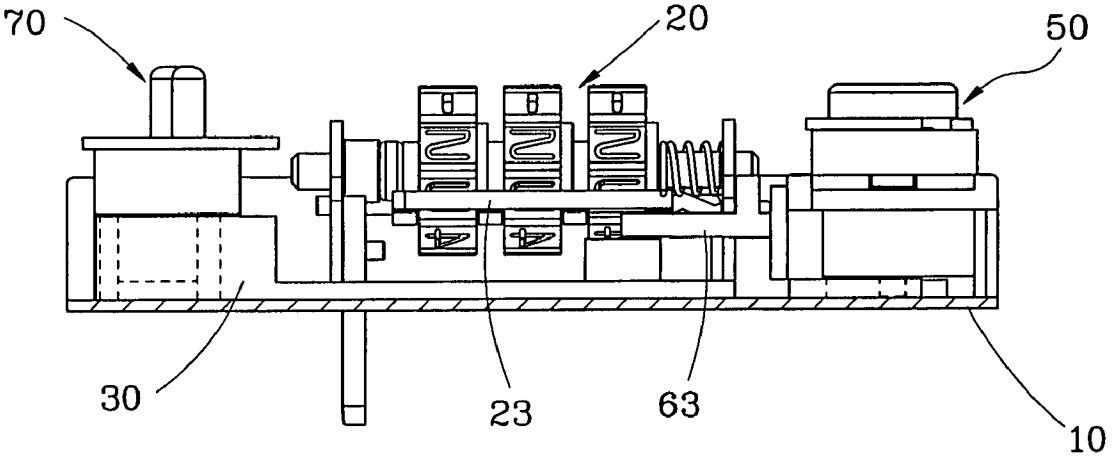
FIG. 11 is a sectional view taken along line 11-11 of FIG. 10.
Figure 12:
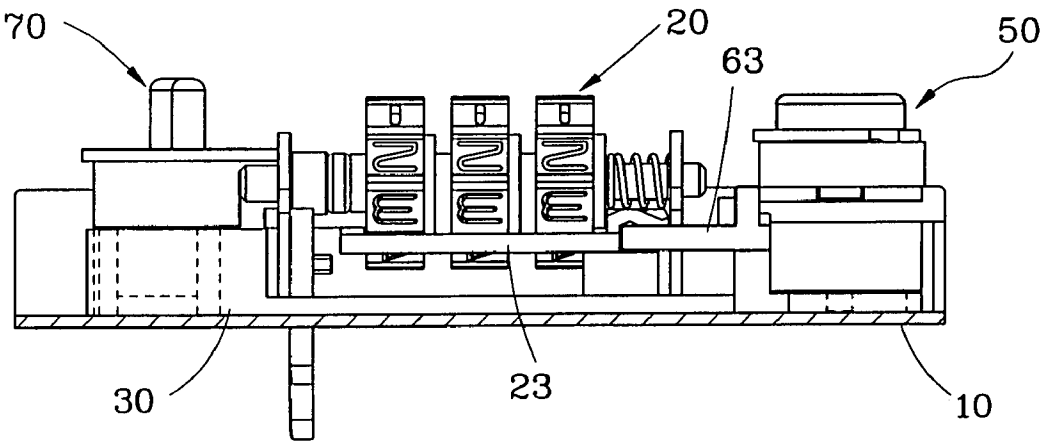
FIG. 12 is similar to FIG. 11 but showing the locking plate moved to the other position.

FIGS. 10~12 show a lock assembly in accordance with a second embodiment of the present invention. This embodiment is substantially similar to the aforesaid first embodiment with the exception of the operating member. According to this second embodiment, the operating member, referenced by 70, is a sliding member mounted in the casing 10 and connected to one side of the locking plate 30. The user can operate the operating member 70 to move the locking plate 30 directly. Further, the locking plate 30 according to this second embodiment eliminates the aforesaid rack 33.

The operation of this second embodiment is substantially similar to the aforesaid first embodiment with the exception that the operating member of the first embodiment is rotatable to move the locking plate by means of the work between the gear and the rack and to simultaneously move the locksets of the suitcase; the operating member of the second embodiment is slidable to directly move the locking plate. The first embodiment and the second embodiment achieve the same effect.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A lock assembly comprising:

a casing; said casing having two lock through holes on one sidewall thereof;

a combination lock mounted in said casing on the middle;

a locking plate mounted in said casing and movable axially forwards/backwards relative to said casing, said locking plate having two butts disposed at one lateral side thereof corresponding to the lock through holes of said casing and a hook portion at one end thereof;

an operating member mounted in one end of said casing and operable to move said locking plate between a first position where said butts are respectively stopped at the lock through holes of said casing and a second position where said butts are moved away from the lock through holes of said casing;

a cylinder lock mounted in an opposite end of said casing, said cylinder lock having a bottom actuating block rotatable with a key; and a link, said link having a protruding block suspending at one side of said combination lock and movable by the bottom actuating block of said cylinder lock between a first position where said link is engaged with the hooked portion of said locking plate for movement with said locking plate and a second position where said link is disengaged from the hooked portion of said locking plate;

wherein said operating member is a rotary knob pivoted to said casing and rotatable to move said casing between the first position and the second position.

2. The lock assembly as claimed in claim 1, wherein said operating member has a gear; said locking plate has a rack meshed with said gear of said operating member.

3. The lock assembly as claimed in claim 2, further comprising a driving member pivoted to a bottom side of said casing and fixedly connected to said operating member for rotation with said operating member.

4. The lock assembly as claimed in claim 3, wherein said driving member two driving rods extending from a bottom side thereof for moving a connecting plate in a suitcase to open two locksets of said suitcase upon rotation of said operating member by an external force.

5. A lock assembly comprising:

a casing; said casing having two lock through holes on one sidewall thereof;

a combination lock mounted in said casing on the middle;

a locking plate mounted in said casing and movable axially forwards/backwards relative to said casing, said locking plate having two butts disposed at one lateral side thereof corresponding to the lock through holes of said casing and a hook portion at one end thereof;

an operating member mounted in one end of said casing and operable to move said locking plate between a first position where said butts are respectively stopped at the lock through holes of said casing and a second position where said butts are moved away from the lock through holes of said casing;

a cylinder lock mounted in an opposite end of said casing, said cylinder lock having a bottom actuating block rotatable with a key; and a link, said link having a protruding block suspending at one side of said combination lock and movable by the bottom actuating block of said cylinder lock between a first position where said link is engaged with the hooked portion of said locking plate for movement with said locking plate and a second position where said link is disengaged from the hooked portion of said locking plate;

wherein said combination lock is comprised of a plurality of notched rotating disc and cam wheel sets, a shaft, and a movable plate.

6. The lock assembly as claimed in claim 5, wherein said operating member is a slide axially slidably mounted in said casing for moving said locking plate directly.

7. The lock assembly as claimed in claim 5, wherein said link has a horizontal bottom wall, a sliding slot is provided on said horizontal bottom wall for receiving the bottom actuating block of said cylinder lock, a vertical sidewall connected to one side of said horizontal bottom wall, and said protruding block, which extends perpendicularly from a top side of said vertical sidewall opposite to said horizontal bottom wall.

8. The lock assembly as claimed in claim 5, wherein the movable plate of said combination lock is disposed at one side of said protruding block of said link.

9. The lock assembly as claimed in claim 5, wherein said operating member is a rotary knob pivoted to said casing and rotatable to move said casing between the first position and the second position.

10. The lock assembly as claimed in claim 9, wherein said operating member has a gear; said locking plate has a rack meshed with said gear of said operating member.

11. The lock assembly as claimed in claim 10, further comprising a driving member pivoted to a bottom side of said casing and fixedly connected to said operating member for rotation with said operating member.

* * * * *